US007501463B2

(12) United States Patent
Kowaki et al.

(10) Patent No.: US 7,501,463 B2
(45) Date of Patent: Mar. 10, 2009

(54) FLAME-RETARDANT POLYESTER FIBER FOR ARTIFICIAL HAIR

(75) Inventors: Toshihiro Kowaki, Osaka (JP); Toshiyuki Masuda, Hyogo (JP); Hiroyuki Shinbayashi, Osaka (JP)

(73) Assignee: Kaneka Corporation, Osaka (JP)

( * ) Notice: Subject to any disclaimer, the term of this patent is extended or adjusted under 35 U.S.C. 154(b) by 329 days.

(21) Appl. No.: 10/579,994

(22) PCT Filed: Nov. 24, 2004

(86) PCT No.: PCT/JP2004/017827

§ 371 (c)(1), (2), (4) Date: May 19, 2006

(87) PCT Pub. No.: WO2005/056894

PCT Pub. Date: Jun. 23, 2005

(65) Prior Publication Data

US 2007/0155870 A1 Jul. 5, 2007

(30) Foreign Application Priority Data

Dec. 8, 2003 (JP) ..... 2003-409689

(51) Int. Cl.
*C08K 5/1515* (2006.01)
*C08K 5/52* (2006.01)
*C08K 5/09* (2006.01)

(52) U.S. Cl. ..... 524/109; 524/147; 524/394

(58) Field of Classification Search ..... 524/109, 524/147, 394
See application file for complete search history.

(56) References Cited

U.S. PATENT DOCUMENTS

| | | | | |
|---|---|---|---|---|
| 4,001,367 | A * | 1/1977 | Guthrie et al. | 264/154 |
| 4,732,921 | A * | 3/1988 | Hochberg et al. | 523/460 |
| 5,866,672 | A | 2/1999 | Ohara et al. | |
| 2004/0195543 | A1 | 10/2004 | Masuda et al. | |

FOREIGN PATENT DOCUMENTS

| | | | |
|---|---|---|---|
| CN | 1153522 | A | 7/1997 |
| EP | 1479798 | * | 11/2004 |
| JP | 60-071713 | A | 4/1985 |
| JP | 62-170519 | A | 7/1987 |
| JP | 2003-221733 | A | 8/2003 |
| WO | WO 03/008679 | A1 | 1/2003 |
| WO | WO 03/071014 | * | 8/2003 |

OTHER PUBLICATIONS

Zhongguofangzhichubanshe, Yaomu et al., "Fangzhicailiaoxue," Jan. 2000, 2nd edition, p. 178, line 8 to line 12, 3 pages.
The Official Action from corresponding Chinese Application No. 200480036051.4, mailed on Nov. 16, 2007, 5 pages.
U.S. Appl. No. 11/345,952, Kowaki et al.
International Search Report from Corresponding International Application No. PCT/JP2004/017827, dated Mar. 1, 2005, 1 page.
International Preliminary Report on Patentability (Chapter 1 of the Patent Cooperation Treaty) from Corresponding International Application No. PCT/JP2004/017827, dated Jul. 27, 2006, 6 pages.
Supplementary European Search Report from Application No. EP 04 79 9887, Sep. 26, 2007, 4 pages.

* cited by examiner

*Primary Examiner*—Kriellion A Sanders
(74) *Attorney, Agent, or Firm*—Hamre, Schumann, Mueller & Larson, P.C.

(57) ABSTRACT

It is an object of the present invention to provide a polyester fiber for artificial hair which has an excellent spinning processability, maintains fiber properties possessed by conventional polyester fiber, and has excellent flame retardance, heat resistance, transparency and the like.

A flame retardant polyester fiber for artificial hair which achieves the above object can be obtained by melt spinning a composition in which 5 to 30 parts by weight of (B) a brominated epoxy based flame retardant and 0.05 to 1 parts by weight of (C) a reaction accelerator is mixed with 100 parts by weight of (A) a polyester made of one or more of polyalkylene terephthalate or a copolymer polyester comprising polyalkylene terephthalate as a main component.

8 Claims, No Drawings

FLAME-RETARDANT POLYESTER FIBER FOR ARTIFICIAL HAIR

RELATED APPLICATIONS

This application is a nationalization of PCT application PCT/JP2004/017827 filed on Nov. 24, 2004 claiming priority to Japanese Application No. 2003-409689 filed on Dec. 8, 2003, the contents of which are incorporated herein by reference in their entirety.

TECHNICAL FIELD

The present invention relates to a flame retardant polyester fiber for artificial hair, formed from a polyester, a brominated epoxy flame retardant and a reaction accelerator. More particularly, the present invention relates to a fiber for artificial hair which has excellent spinning processability, maintains fiber properties such as flame resistance, heat resistance, strength and elongation, and also has excellent transparency and the like.

BACKGROUND ART

Fibers made of polyethylene terephthalate or a polyester comprising polyethylene terephthalate as a main component have a high melting point, a high modulus of elasticity, excellent heat resistance and chemical resistance. Thus, they are widely used in curtains, carpets, clothes, blankets, sheetings, table clothes, upholstery fabrics, wall coverings, artificial hair, interior materials for automobiles, outdoor reinforcing materials, and safety nets.

On the other hand, human hair or artificial hair (modacrylic fibers, polyvinyl chloride fibers) or the like have conventionally been used in hair products such as wigs, hair wigs, extensions, hair bands, and doll hair. However, because it has now become difficult to obtain human hair, artificial hair has become more important. Modacrylic fibers have often been used as artificial hair materials because of their flame retardance, but they have insufficient heat resistance.

In recent years there has been proposed, as a main component for artificial hair, a polyester typified by polyethylene terephthalate which has excellent heat resistance. However, fibers made of a polyester typified by polyethylene terephthalate are flammable, and thus have insufficient flame resistance.

Historically, various attempts have been made to improve the flame resistance of polyester fibers. Known examples include using a fiber made of a polyester obtained by copolymerizing a flame retardant monomer containing a phosphorus atom. Known examples also include adding a flame retardant to a polyester fiber.

As a method which involves copolymerizing a flame retardant monomer, for example, several methods have been proposed. Copolymerizing a phosphorus compound with excellent heat stability having a phosphorus atom as a ring member is disclosed in Japanese Patent Publication No. 55-41610, copolymerizing carboxyphosphinic acid is disclosed in Japanese Patent Publication No. 53-13479, and copolymerizing a polyester containing a polyarylate with a phosphorus compound is disclosed in Japanese Laid-open Patent No. 11-124732. As artificial hair to which flame retardant technology is applied, a polyester fiber copolymerized with a phosphorus compound has been proposed in Japanese Laid-open Patent No. 03-27105 and in Japanese Laid-open Patent No. 05-339805, for example.

However, since artificial hair is required to be highly flame resistant, the copolymer polyester fiber used for artificial hair must have a high copolymerization amount. This results in a significant decrease in heat resistance of the polyester, and causes other problems which make it difficult to perform melt spinning. Also, when a flame approaches, the artificial hair does not catch fire and burn, but becomes molten and drips. When a phosphorus flame retardant is added, stickiness is increased because it must be added in a large amount to provide flame retardance, and the resulting artificial hair made of a polyester fiber tends to be devitrified by prolonged heat or high humidity conditions so as to affect the appearance of the fiber.

On the other hand, as a method which involves adding a flame retardant, it has been proposed to add a halogenated cycloalkane compound as fine particles to a polyester fiber, as disclosed in Japanese Patent Publication No. 03-57990, or add a bromine-containing alkylcyclohexane to a polyester fiber, as disclosed in Japanese Patent Publication No. 01-24913. However, in the method which involves adding a flame retardant to a polyester fiber, in order to achieve sufficient flame retardance the addition treatment temperature must be as high as 150° C. or more, the addition treatment time must be long, or a large amount of a flame retardant must be used. This causes problems such as deteriorated fiber properties, reduced productivity and an increased production cost.

In the spinning process for producing a polyester based filament for artificial hair, water-cooling of the process is conventionally employed. However production speed is low in this case and, further, the process is expensive because drying is necessary. In a melt spinning by air-cooling process, it is important to maintain high melt viscosity of the resin composition in order to obtain desired filament size (fineness of filament). A decrease in the melt viscosity results in lowered spinning processability and causes a problem in which a desirable filament cannot be produced stably. As described above, artificial hair fiber which has excellent spinning processability, maintains fiber properties possessed by a conventional polyester fiber and has excellent flame retardance, heat resistance and transparency, has not yet been produced.

DISCLOSURE OF THE INVENTION

An object of the present invention is to provide a fiber for artificial hair which has excellent spinning processability, excellent flame retardance, heat resistance and transparency and the like, by solving the aforedescribed existing problems.

In order to solve the aforedescribed problems, the inventors have conducted intensive studies. They have found that flame retardant polyester based fibers for artificial hair which have the flame retardant properties, setting properties, transparency, devitrification resistance and calming properties required for artificial hair, and have excellent spinning processability in an air-cooling process which maintains fiber properties possessed by a conventional polyester such as heat resistance, strength and elongation, can be obtained by melt spinning a composition comprising a polyester, a brominated epoxy based flame retardant and a reaction accelerator.

Specifically, the present invention relates to a flame retardant polyester fiber for artificial hair, formed from 100 parts by weight of (A) a polyester made of one or more of polyalkylene terephthalate or a copolymer polyester comprising polyalkylene terephthalate as a main component, 5 to 30 parts by weight of (B) a brominated epoxy based flame retardant and 0.05 to 1 parts by weight of (C) a reaction accelerator.

The present invention also relates to the flame retardant polyester fiber for artificial hair wherein the component (A) is a polyester formed from at least one polymer selected from the group consisting of polyethylene terephthalate, polypropylene terephthalate and polybutylene terephthalate. The present invention also relates to the flame retardant polyester fiber for artificial hair wherein the component (B) is a flame retardant represented by the general formula (1),

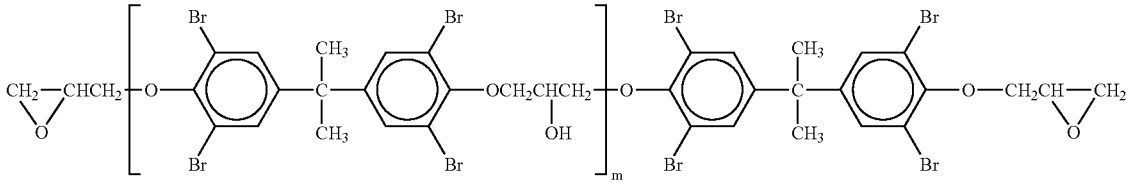

(1)

wherein m represents 0 to 100. The present invention also relates to the flame retardant polyester fiber for artificial hair wherein the component (C) is a metal salt of organic carboxylic acid having 6 to 32 carbon atoms and/or a phosphite based compound.

Furthermore, the present invention relates to the flame retardant polyester fiber for artificial hair wherein the fiber is preferably non-crimped and spun dyed, and the size of single fiber is 10 to 80 dtex.

BEST MODE FOR CARRYING OUT THE INVENTION

The flame retardant polyester fiber for artificial hair of the present invention is a fiber obtained by melt spinning a composition comprising (A) a polyester made of one or more of polyalkylene terephthalate or a copolymer polyester comprising polyalkylene terephthalate as a main component, and (B) a brominated epoxy flame retardant. Examples of the polyalkylene terephthalate or the copolymer polyester comprising polyalkylene terephthalate as a main component, which is contained in the polyester (A) used in the present invention, include polyalkylene terephthalates such as polyethylene terephthalate, polypropylene terephthalate, and polybutylene terephthalate, and a copolymer polyester comprising such polyalkylene terephthalate as a main component and a small amount of a copolymerization component. The phrase "containing as a main component" refers to "containing in an amount of 80 mol % or more".

Examples of the copolymerization component include: polycarboxylic acids such as isophthalic acid, orthophthalic acid, naphthalenedicarboxylic acid, paraphenylenedicarboxylic acid, trimellitic acid, pyromellitic acid, succinic acid, glutaric acid, adipic acid, suberic acid, azelaic acid, sebacic acid, and dodecanedioic acid, and their derivatives; dicarboxylic acids having sulfonic acid salt such as 5-sodium sulfoisophthalic acid, dihydroxyethyl 5-sodium sulfoisophthalate, and their derivatives; 1,2-propanediol, 1,3-propanediol, 1,4-butanediol, 1,6-hexanediol, neopentyl glycol, 1,4-cyclohexanedimethanol, diethylene glycol, polyethylene glycol, trimethylolpropane, pentaerythritol, 4-hydroxybenzoic acid, and ϵ-caprolactone.

Typically, the copolymer polyester is preferably produced by adding a small amount of a copolymerization component to a main component which is a polymer of terephthalic acid and/or its derivative (for example, methyl terephthalate) and alkylene glycol, and reacting these components with a view toward stability and convenience for handling. However, the copolymer polyester may be produced by adding a small amount of a monomer or oligomer component as a copolymerization component to a main component which is a mixture of terephthalic acid and/or its derivative (for example, methyl terephthalate) and alkylene glycol, and polymerizing the components.

The copolymer polyester may be any copolymer polyester in which the copolymerization component is polycondensed with the main chain and/or the side chain of polyalkylene terephthalate as a main component. There are no particular limitations to the manner of polymerization and the like.

Examples of the copolymer polyester comprising polyalkylene terephthalate as a main component include: a polyester obtained by copolymerizing polyethylene terephthalate as a main component with ethylene glycol ether of bisphenol A; a polyester obtained by copolymerizing polyethylene terephthalate as a main component with 1,4-cyclohexanedimethanol; and a polyester obtained by copolymerizing polyethylene terephthalate as a main component with dihydroxyethyl 5-sodium sulfoisophthalate.

The polyalkylene terephthate and its copolymer polyester may be used singly or in a combination of two or more. Preferable examples thereof include polyethylene terephthalate, polypropylene terephthalate, polybutylene terephthalate, and a copolymer polyester (a polyester obtained by copolymerizing polyethylene terephthalate as a main component with ethylene glycol ether of bisphenol A; a polyester obtained by copolymerizing polyethylene terephthalate as a main component with 1,4-cyclohexanedimethanol; a polyester obtained by copolymerizing polyethylene terephthalate as a main component with dihydroxyethyl 5-sodium sulfoisophthalate; or the like). A mixture of two or more of these is also preferable.

The component (A) has an intrinsic viscosity of preferably 0.3 to 1.2, and more preferably 0.3 to 1.0. If the intrinsic viscosity is less than 0.3, the resulting fiber tends to have reduced mechanical strength. If more than 1.2, the melt viscosity is increased as the molecular weight is increased, and thus the fiber tends to be melt spun only with difficulty, and to have a non-uniform size.

There are no specific limitations to the brominated epoxy flame retardant (B) used in the present invention, except that the flame retardant (B) is terminal non-blocked. A conventional brominated epoxy flame retardant may be used.

Specific examples of the component (B) include terminal non-blocked brominated epoxy based flame retardant represented by the general formula (1). Among these it is preferable to use compounds represented by the formulas below. These may be used alone or in combinations of two or more. metal salts of organic carboxylic acid having 6 to 32 carbon atoms include metal salts of caproic acid, caprylic acid, capric acid, lauric acid, myristic acid, palmitic acid, stearic acid, arachidic acid, behenic acid, lignoceric acid, montanic acid and the like. These may be used alone or in combinations of

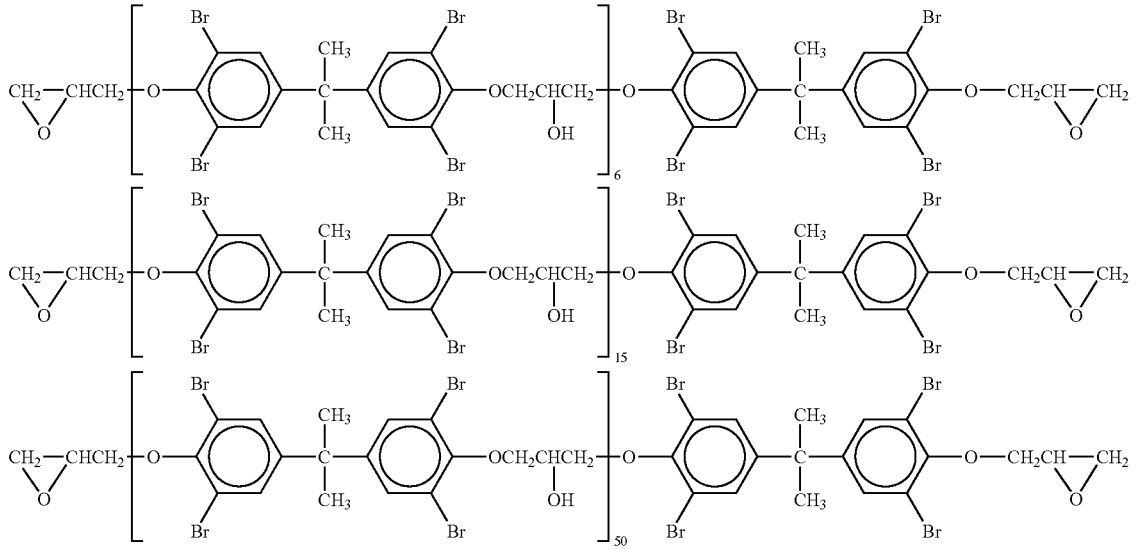

The component (B) is used in an amount of 5 to 30 parts by weight based on 100 parts by weight of the component (A). In particular, the amount is preferably 6 to 25 parts by weight, and more preferably 8 to 20 parts by weight. If the component (B) is used in an amount of less than 5 parts by weight, it is difficult to achieve a flame retardant effect. If more than 30 parts by weight, mechanical properties, heat resistance, and drip resistance are impaired.

The component (B) has a number average molecular weight of preferably 2,000 to 35,000, and more preferably 2,000 to 25,000. If the number average molecular weight is less than 2,000, a reaction of terminal carboxylic acid of polyester is accelerated during melt kneading or spinning, and thus results in gelation which deteriorates spinning processability. If the molecular weight is more than 35,000, the reactivity of terminal carboxylic acid of polyester is lowered, and the polyester does not have sufficient melt viscosity for stable spinning in an air-cooling process.

The component (C) of the present invention is a substance which accelerates the reaction between terminal carboxylic acid group of the component (A) and epoxy group of the component (B). The reactivity between terminal carboxylic acid group of the component (A) and epoxy group of the component (B) is insufficient when simply melt kneading component (A) and component (B). However, by adding component (C) and melt kneading, the reaction can be accelerated, and thus the melt viscosity of the resin composition is increased, improving the melt spinning processability in the air-cooling process. Examples of the component (C) include metal salts of organic carboxylic acid having 6 to 32 carbon atoms and phosphite based compounds. Examples of the two or more. Examples of phosphite based compound include trialkyl phosphites, triaryl phosphites, alkyl aryl phosphites, phosphite based antioxidants represented by the general formulas (2) to (5) and the like,

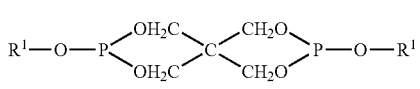

(2)

wherein $R^1$ represents linear or branched hydrocarbon group having 4 to 20 carbon atoms and a plurality of $R^1$s may be the same or different,

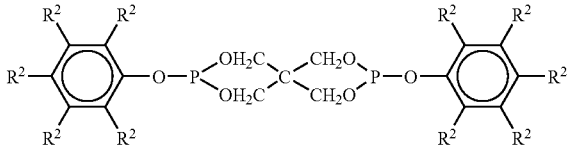

(3)

wherein $R^2$ represents hydrogen atom or a hydrocarbon group having 1 to 10 carbon atoms and a plurality of $R^2$s may be the same or different,

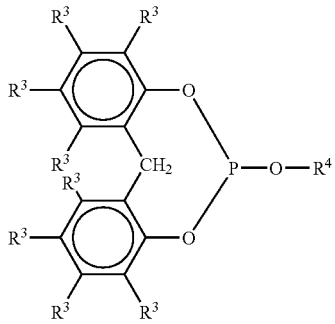

(4)

wherein $R^3$ represents hydrogen atom or a hydrocarbon group having 1 to 10 carbon atoms and a plurality of $R^3$s may be the same or different, $R^4$ represents hydrocarbon group having 4 to 20 carbon atoms or aromatic hydrocarbon group having 6 to 20 carbon atoms,

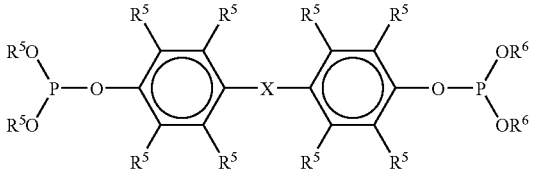

(5)

wherein $R^5$ represents hydrogen atom or a hydrocarbon group having 1 to 10 carbon atoms and a plurality of $R^5$s may be the same or different, $R^6$ represents hydrocarbon group having 4 to 20 carbon atoms or aromatic hydrocarbon group having 6 to 20 carbon atoms and a plurality of $R^6$s may be the same or different, X represents methylene group, ethylidene group, isopropylidene group, carbonyl group, sulfonyl group, 1,3-phenylene-diisopropylidene group or 1,4-phenylene-diisopropylidene group.

Examples of the phosphite compound, i.e., the trialkyl phosphites, triaryl phosphites and alkylaryl phosphites and phosphite compounds such as the phosphite-based antioxidants represented by the general formulae (2) to (5), include: trialkyl phosphites such as trioctyl phosphite, tridecanyl phosphite, etc.; triaryl phosphites such as triphenyl phosphite, tris(nonylphenyl) phosphite, tris(2,4-di(t-butyl)phenyl) phosphite; alkylaryl phosphites such as decanyl phenyl phosphite, decanyl diphenyl phosphite, octyl diphenyl phosphite, etc.; and the phosphite-based antioxidants represented by the general formula (2) to (5) including compounds represented by following formulas. These compounds may be used alone or as a mixture of two or more thereof.

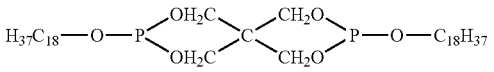

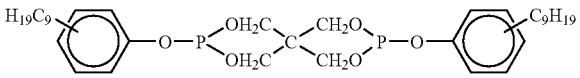

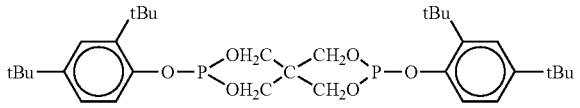

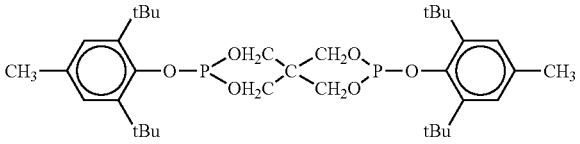

-continued

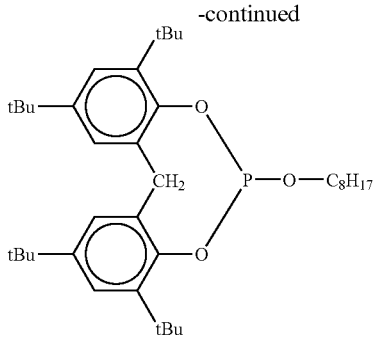

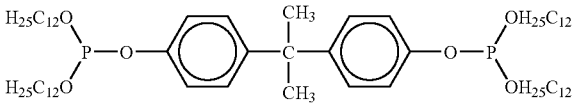

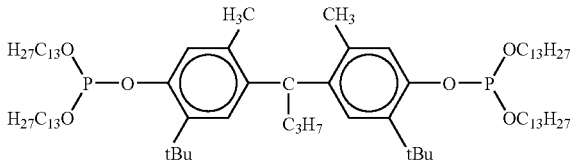

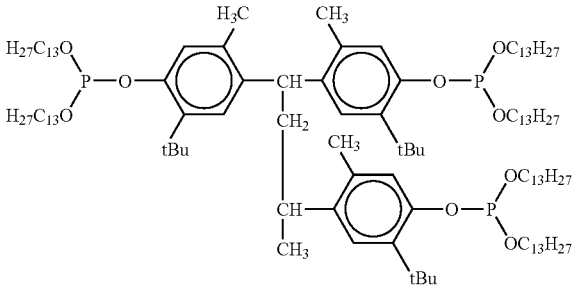

The amount of the component (C) used is 0.05 to 1 parts by weight based on 100 parts by weight of the component (A). Above all, the amount of 0.1 to 1 parts by weight is preferable, and the amount of 0.2 to 0.8 parts by weight is more preferable. When the amount used is less than 0.05 parts by weight, the reactivity between terminal carboxylic group of the component (A) and epoxy group of the component (B) is impaired, and thus satisfactory melt viscosity cannot be achieved to perform an air-cooling melt spinning process. When the amount used is more than 1 parts by weight, the reaction is accelerated and excessively results in gelation, which deteriorates spinning processability.

It is preferable to react component (A) and component (B) using component (C), since the transparency of obtained filament is significantly improved. Also the melt viscosity is increased, improving air-cooling melt spinning processability.

The flame retardant polyester composition used in the present invention can be produced by, for example, dry blending the components (A), (B) and (C) in advance and then melt kneading the components in various common kneading machines. Examples of the kneading machines include a single-screw extruder, twin-screw extruder, roll, Banbury mixer, and kneader. Of these, a twin-screw extruder is preferable in terms of adjustment of the kneading degree and convenience of operation.

The flame retardant polyester fiber for artificial hair of the present invention can be produced by melt spinning the flame retardant polyester composition by a typical melt spinning process.

Specifically, a spun yarn can be obtained by, for example: melt spinning the composition while setting an extruder, gear pump, spinneret, and the like at a temperature of 270 to 310° C.; allowing the spun yarn to pass through a heat sleeve;

then cooling the yarn to a glass transition temperature or lower; and taking off the yarn at a rate of 50 to 5,000 m/min. The size of the spun yarn can also be controlled by cooling the yarn in a tank filled with cooling water. The temperature or length of the heat sleeve, the temperature or spraying amount of cooling air, the temperature of the cooling tank, the cooling time, and the take-off rate can be appropriately adjusted according to the discharge amount and the number of holes in the spinneret.

The resulting spun yarn may be hot drawn by either a two-step process comprising winding up the spun yarn once and then drawing the yarn, or a direct spinning and drawing process comprising successively drawing the spun yarn without winding. Hot drawing is carried out by a one-stage drawing process or a multistage drawing process. As a heating means in hot drawing, a heat roller, heat plate, steam jet apparatus, hot water tank, or the like can be used. These can be appropriately used in combination.

The flame retardant polyester fiber for artificial hair of the present invention may contain various additives such as a flame retardant other than the component (B), a heat resistant agent, a photostabilizer, a fluorescent agent, an antioxidant, an antistatic agent, a pigment, a plasticizer, and a lubricant as required. The fiber containing a pigment can be provided as a spun dyed fiber.

When the flame retardant polyester fiber for artificial hair of the present invention thus obtained is a fiber in the form of a non-crimped fiber, and has a size of usually 10 to 80 dtex, and furthermore 35 to 75 dtex, the fiber is suitable for artificial hair. Preferably, the fiber for artificial hair has heat resistance sufficient to allow a thermal beauty appliance (hair iron) to be used thereon at 160 to 200° C. Preferably, the fiber catches fire only with difficulty, and has self-extinguishing properties.

When the flame retardant polyester fiber of the present invention is spun dyed, the fiber can be used as is. When the fiber is not spun dyed, it can be dyed under the same conditions as with a common flame retardant polyester fiber. The pigment, dye, adjuvant, or the like used for dyeing preferably exhibits excellent weather resistance and flame retardance.

The flame retardant polyester fiber for artificial hair of the present invention exhibits excellent curl setting properties when a thermal beauty appliance (hair iron) is used, and also exhibits excellent curl holding properties. When a delustering agent is added to the fiber, if necessary, the fiber can have a surface with irregularities, can be appropriately matted, and can be more suitably used for artificial hair. Further, an oil agent such as a fiber surface treating agent or a softening agent can provide the fiber with feeling and texture closer to human hair.

The flame retardant polyester fiber for artificial hair of the present invention may be used in combination with another material for artificial hair, such as a modacrylic fiber, a polyvinyl chloride fiber, or a nylon fiber, or it may be used in combination with human hair.

Generally, human hair used in hair products such as wigs, hair wigs, or extensions has its cuticle treated, is bleached or dyed, and contains a silicone based fiber treating agent or softening agent in order to ensure its feeling and combing properties. As a result, this human hair is flammable, unlike untreated human hair. However, when this human hair is blended with the flame retardant polyester fiber for artificial hair of the present invention at a human hair blending ratio of 60% or less, the product exhibits excellent flame retardance.

EXAMPLES

Next, the present invention will be described in more detail with reference to Examples. However, it should be understood that the present invention is not limited thereto. Properties values are measured as follows in the Examples.

(Strength and Elongation)

Tensile strength and elongation of a filament are measured using INTESCO Model 201 manufactured by INTESCO Co., Ltd. Both 10 mm-long ends of one 40 mm-long filament are sandwiched in a board (thin paper) to which a two-sided tape applied with an adhesive is bonded, and are air-dried overnight to prepare a sample with a length of 20 mm. The sample is mounted on a test machine, and a test is carried out at a temperature of 24° C., at a humidity of 80% or less, at a load of 0.034 cN×size (dtex), and at a tensile rate of 20 mm/min to measure strength and elongation.

The test is repeated ten times under the same conditions, and the average values are defined as strength and elongation of the filament.

(Flame Retardance)

A filament having a size of 50 dtex is cut into filaments with a length of 150 mm each. Filaments with a weight of 0.7 g are bundled, with one end of the bundle sandwiched by a clamp, and the bundle is fixed on a stand and hung vertically. The fixed filaments with an effective length of 120 mm are brought into contact with a 20 mm-long flame for 3 seconds and burned. Flammability is evaluated as follows.

Very good: Afterflame time is 0 second (Filaments do not catch fire)

Good: Afterflame time is less than 3 seconds

Fair: Afterflame time is 3 to 10 seconds

Bad: Afterflame time is more than 10 seconds

Drip resistance is evaluated as follows.

Very good: The number of drips until extinguishment is 0

Good: The number of drips until extinguishment is 5 or less

Fair: The number of drips until extinguishment is 6 to 10

Bad: The number of drips until extinguishment is 11 or more (Transparency)

A tow filament with a length of 30 cm and a total size of 100,000 dtex is visually evaluated under sunlight.

Good: Sufficiently transparent and deep-colored (bright)

Fair: Transparent

Fair: A little opaque (cloudy)

Bad: Opaque and not deep-colored (Combing Properties)

A tow filament with a length of 30 cm and a total size of 100,000 dtex is soaked in a 3% aqueous solution of fiber surface treating agent comprising PO/EO random copolymer (molecular weight, 20000) and cationic antistatic agent in a 50/50 ratio. The tow filament is allowed to have 0.1% of each component, and then dried at 80° C. for 5 minutes. Ease of combing is evaluated by combing the treated tow filament over 30 times thoroughly downward from a point 3 cm below the top of the tow at a speed of 0.3 m/s by using a New Delrin Comb No. 826.

Good: Filament is combed with almost no resistance (light)

Fair: Filament is combed with a little resistance (heavy)

Bad: Filament is combed with a large resistance, or becomes uncombable in the middle (Cold Setting Properties)

A 160 mm filament is stretched straightly, and both the ends are fixed with a tape and heated at 100° C. for 40 minutes. After cooling to room temperature, the filament is cut into a piece of 85 mm which is then folded in two, and both the ends are connected with sewing thread and suspended from a bar with a diameter of 4 mm. A loading of 6.7 mg/dtex is fixed to the sample which is then maintained at 30° C. under 60% RH for 24 hours. The loading is removed, and the sample is left for 5 minutes and cut to give a 80 mm sample which is then measured for the bending (angle) of the filament. The bending is regarded as an indication of the ease of curling at low temperatures, and it is most preferable that the recovered filament is straight (180°)

(Curl Holding Properties)

Straw-haired filaments are wound around a pipe with a diameter of 32 mm. Curl setting is performed at 120° C. for 60 minutes, and aging is performed at room temperature for 60 minutes. Then, one ends of the curled filaments are fixed, and the filaments are hung down to measure the initial filament length and the length after 7 days. These lengths are regarded as an indication of the ease and holding ability of curling. It is preferable that the initial filament length is shorter. In addition, it is preferable to be able to perform the curl setting at lower temperature and also at higher temperature.

(Iron Setting Properties)

Iron setting properties are an index of the extent to which a hair iron can perform curl setting easily and hold the curl shape. Filaments are loosely sandwiched in a hair iron heated to 180° C., and pre-heated three times by rubbing. Adhesion among the filaments, combing, crimping and end breakage of the filaments are visually evaluated at this time. Next, the pre-heated filaments are wound around the hair iron and held for 10 seconds, after which the iron is withdrawn. The degree of ease with which the iron is withdrawn (rod withdrawal properties), and curl holding properties when the iron is withdrawn are visually evaluated.

(Devitrification Resistance)

A tow filament with a length of 10 cm and a total size of 100,000 dtex is processed with steam (at 120° C. and at a relative humidity of 100% for 1 hour), and then sufficiently dried at room temperature. The change in gloss and hue between the tow filament before steam processing and the tow filament after steam processing is examined. The more significant is the change, the lower devitrification resistance which the tow element exhibits.

Very good: Neither gloss nor hue is changed

Good: Gloss is not changed, but hue is slightly changed

Fair: Both gloss and hue are slightly changed

Bad: Both gloss and hue are obviously changed (Stickiness)

A tow filament with a length of 30 cm and a total size of 100,000 dtex is allowed to stand in a thermo-hygrostatic chamber (at 23° C. and at a relative humidity of 55%) for 3 hours, and then evaluated using a thumb, forefinger, and middle finger on the right hand.

Good: Not sticky

Fair: A little sticky

Bad: Sticky (Melt Viscosity)

Melt Viscosity was measured using a capirograph manufactured by Toyo Seiki Seisaku-sho, LTD. The measurement was performed with a test speed of 50 mm/min, an orifice radius of 0.0500 cm, a barrel radius of 0.4775 cm and a barrel temperature of 280° C. Melt viscosity was calculated from following formulas, $$\text{shear pressure } \tau = Pr/2L = Fr/2\pi R^2 L \quad (1)$$

$$\text{shear speed } \gamma = 4Q/\pi r^3 = 4V/60\pi r^3 \quad (2)$$

$$\text{apparent viscosity } \eta = \tau/\gamma \quad (3)$$

wherein, P is inner pressure of barrel, F is extrusion load, R is barrel radius, r is capillary radius, L is capillary length, Q is flow value, V is extrusion amount and v is extrusion speed.

(Spinning Processability)

Good: Spinning was stably performed.

Fair: Spinning was possible, but desired filament size was not obtained.

Bad: Spinning was not stably performed due to end breakage of thread, melt adhesion and the like.

Examples 1 to 8

To a composition comprising polyethylene terephthalate dried so as to have a moisture content of 100 ppm or less, a brominated epoxy flame retardant and a reaction accelerator at a composition ratio shown in Table 1 below, 2 parts of a coloring polyester pellet PESM6100 BLACK (manufactured by Dainichiseika Color & Chemicals Mfg. Co., Ltd., carbon black content: 30%, polyester contained in the component (A)) were added. The components were dry blended. The blend was fed into a twin-screw extruder and melt kneaded at 280° C. to form a pellet. Then, the pellet was dried to a moisture content of 100 ppm or less. Next, the pellet was put into a melt spinning machine, and the molten polymer was discharged from a spinneret having round cross-sectional nozzle holes with a nozzle diameter of 0.5 mm and each nozzle at 280° C. Then the discharged polymer was allowed to pass through a heat sleeve, cooled to the glass transition temperature or less, and rolled up at a rate of 100 to 150 m/min to obtain a spun yarn. The resulting spun yarn was drawn in a hot water bath at 80° C. to prepare a yarn at a draw ratio of 4. The drawn yarn was wound up around a heat roll, which was heated to 200° C., at a rate of 100 m/min, and heat-treated to prepare a polyester fiber (multi filament) with a size of around 50 dtex.

TABLE 1

| | | Example | | | | | | | |
|---|---|---|---|---|---|---|---|---|---|
| | | 1 | 2 | 3 | 4 | 5 | 6 | 7 | 8 |
| PET | EFG-85A *1 | 100 | 100 | 100 | 100 | 100 | 100 | 100 | |
| | EFG-10 *2 | | | | | | | | 100 |
| Brominated | SR-T20000 *3 | | | | | | 15 | | |
| epoxy based | SR-T10000 *4 | 15 | 15 | 8 | 12.5 | 10 | | 10 | 10 |
| flame retardant | SR-T2000 *5 | | | | 2.5 | | | 5 | 5 |

TABLE 1-continued

| | | Example | | | | | | | |
|---|---|---|---|---|---|---|---|---|---|
| | | 1 | 2 | 3 | 4 | 5 | 6 | 7 | 8 |
| Reaction Accelerator | Sodium montanate *6 | 0.1 | 0.3 | 0.3 | 0.3 | 0.3 | 0.3 | | 0.6 |

*1: Polyethylene terephthalate, manufactured by Kanebo Gohsen, Ltd, IV value = 0.85.
*2: Polyethylene terephthalate, manufactured by Kanebo Gohsen, Ltd, IV value = 0.60.
*3: Terminal non-blocked brominated epoxy flame retardant, number average molecular weight: 30,000, manufactured by Tohto Kasei Co., Ltd.
*4: Terminal non-blocked brominated epoxy flame retardant, number average molecular weight: 17,000, manufactured by Tohto Kasei Co., Ltd.
*5: Terminal non-blocked brominated epoxy flame retardant, number average molecular weight: 4,000, manufactured by Tohto Kasei Co., Ltd.
*6: Sodium montanate, manufactured by Clariant (Japan) K.K.
*7 Phosphite based compound, manufactured by Daiichi Chemical Industry Co., Ltd.

Strength and elongation, flame retardance, gloss, cold setting properties, curl holding properties, iron setting properties, devitrification resistance, stickiness and combing properties of the resulting fiber were evaluated. The results are shown in Table 2 below.

TABLE 2

| | | Example | | | | | | | | Comparative Example | | |
|---|---|---|---|---|---|---|---|---|---|---|---|---|
| | | 1 | 2 | 3 | 4 | 5 | 6 | 7 | 8 | 1 | 2 | 3 |
| Size (dtex) | | 51 | 50 | 48 | 53 | 51 | 50 | 53 | 50 | 20 | — | 50 |
| Strength (cN) | | 2.7 | 2.9 | 2.5 | 2.7 | 2.9 | 2.8 | 3 | 3.1 | 2.3 | — | 1.9 |
| Elongation (%) | | 45 | 48 | 50 | 50 | 48 | 46 | 43 | 45 | 45 | — | 42 |
| Flame retardance | Flammability | Very good | Very good | Good | Very good | Very good | Very good | Very good | Very good | — | — | Fair |
| | Drip resistance | Good | Very good | Good | Very good | Very good | Good | Very good | Very good | — | — | Bad |
| Transparence | | Very good | Very good | Very good | Very good | Very good | Very good | Very good | Very good | Good | — | Fair |
| Combing properties | | Good | Good | Good | Good | Good | Good | Good | Good | Good | — | Bad |
| Cold setting properties(°) | | 112 | 114 | 111 | 113 | 113 | 114 | 112 | 114 | — | — | 103 |
| Devitrification resistance | | Good | Very good | Good | Very good | Very good | Good | Very good | Very good | Very good | — | Bad |
| Stickiness | | Good | Good | Good | Good | Good | Good | Good | Good | Good | — | |
| Curl holding properties (110° C.) | Initial length | 17.6 | 17.7 | 17.6 | 17.2 | 17.3 | 18.1 | 17.5 | 17.6 | — | — | 17.5 |
| | After 7 days | 21.1 | 21.1 | 21.3 | 20.5 | 20.8 | 21.6 | 21.1 | 20.8 | — | — | 22.1 |
| | Elongation (%) | 19.9 | 19.2 | 21.0 | 19.2 | 20.2 | 19.3 | 20.6 | 18.2 | — | — | 26.3 |
| Iron setting properties (180° C.) | Adhesion | Good | Good | Good | Good | Good | Good | Good | Good | — | — | Bad |
| | Crimping/end breakage | Good | Good | Good | Good | Good | Good | Good | Good | — | — | Fair |
| | Rod out | Good | Good | Good | Good | Good | Good | Good | Good | — | — | Bad |
| | Holding properties | Good | Good | Good | Good | Good | Good | Good | Good | — | — | Good |
| Melt viscosity (Pa sec) | | 265 | 275 | 264 | 301 | 330 | 260 | 345 | 280 | 195 | 112 | 112 |
| Spinning processability | | Good | Good | Good | Good | Good | Good | Good | Good | Fair | Bad | Good |

Comparative Example 1

To 100 parts by weight of a polyethylene terephthalate (EFG-85A, manufactured by Kanebo Gohsen, Ltd.) dried to have a moisture content of 100 ppm or less, 15 parts by weight of a brominated epoxy flame retardant (SR-T10000, terminal non-blocked brominated epoxy flame retardant, manufactured by Sakamoto Yakuhin Kogyo Co., Ltd.) and 2 parts by weight of a coloring polyester pellet (PESM6100 BLACK, manufactured by Dainichiseika Color & Chemicals Mfg. Co., Ltd., carbon black content: 30%) were added. The components were dry blended. Next, air-cooling melt spinning was performed by discharging the molten polymer from a spinneret having round cross-sectional nozzle holes with a nozzle diameter of 0.5 mm. However no fiber having desired filament size was obtained due to insufficient melt viscosity. The resulting spun yarn was drawn in a hot water bath at 80° C. to prepare a yarn at a draw ratio of 4. The drawn yarn was wound up around a heat roll, which was heated to 200° C., at a rate of 100 m/min, and heat-treated to prepare a polyester fiber (multi filament) with a size of 20 dtex. Evaluations of flame retardance, cold setting properties, curl holding properties, iron setting properties were not carried out, since the desired size of filament was not obtained.

Comparative Example 2

To 100 parts by weight of polyethylene terephthalate (EFG-85A, manufactured by Kanebo Gohsen, Ltd.), 10 parts by weight of a phosphorus based flame retardant (PX-200, manufactured by Daihachi Chemical Industry Co., Ltd) and 2 parts of a coloring polyester pellet PESM6100 BLACK (manufactured by Dainichiseika Color & Chemicals Mfg. Co., Ltd., carbon black content: 30%) were added. The components were dry blended. Next, air-cooling melt spinning was performed by discharging the molten polymer from a spinneret having round cross-sectional nozzle holes with a nozzle diameter of 0.5 mm. However, it was impossible to wind up the obtained fiber because of frequent thread breakage due to insufficient melt viscosity.

Comparative Example 3

Comparative Example 2 was repeated, except a water-cooling melt spinning process was used (the discharged molten polymer was cooled in a water bath at 30° C. located 25 cm under the spinneret and was wound up at a rate of 100 meter/minute to obtain a spun yarn), instead of an air-cooling melt spinning process, to obtain a polyester fiber (multifilament) having a monofilament size of about 50 dtex. The resulting spun yarn was drawn in a hot water bath at 80° C. to prepare a yarn at a draw ratio of 4. The drawn yarn was wound up around a heat roll, heated to 200° C. at a rate of 100 m/min and heat-treated.

Strength and elongation, flame retardance, gloss, cold setting properties, curl holding properties, iron setting properties, devitrification resistance, stickiness and combing properties of the resulting fiber were evaluated. The results are shown in Table 2 above.

As shown in Table 2, it can be observed that the fiber of the examples made by the air cooling spinning process has better spinning processability and transparency than the fiber of the Comparative Examples 1 and 2. It can also be observed that the fiber of the examples is superior in flame retardance, heat resistance, transparency, combing properties, iron setting properties, devitrification resistance and stickiness to the fiber of the Comparative Example 3.

INDUSTRIAL APPLICABILITY

According to the present invention, it is possible to provide a fiber for artificial hair which has an excellent spinning processability, maintains fiber properties possessed by conventional polyester fiber, and has excellent flame retardance, heat resistance and transparency and the like.

The invention claimed is:

1. A flame retardant polyester fiber for artificial hair, formed from 100 parts by weight of (A) a polyester made of one or more of polyalkylene terephthalate or a copolymer polyester comprising polyalkylene terephthalate as a main component, 5 to 30 parts by weight of (B) a brominated epoxy based flame retardant and 0.05 to 1 parts by weight of (C) a reaction accelerator which accelerates the reaction between terminal carboxylic acid group of the component (A) and epoxy group of the component (B).

2. The flame retardant polyester fiber for artificial hair according to claim 1, wherein the component (A) is at least one polymer selected from the group consisting of polyethylene terephthalate, polypropylene terephthalate and polybutylene terephthalate.

3. The flame retardant polyester fiber for artificial hair according to claim 1, wherein the component (B) is a flame retardant represented by the following general formula (1),

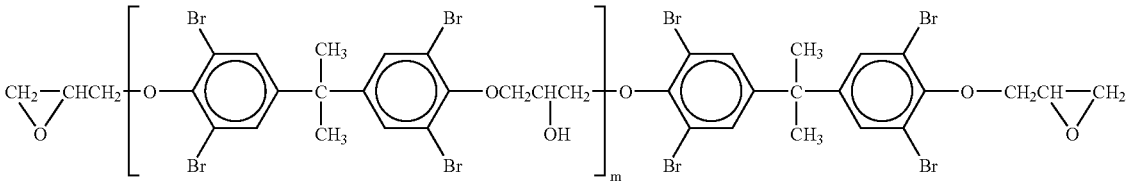

(1)

wherein m represents 0 to 100.

4. The flame retardant polyester fiber for artificial hair according to claim 1, wherein the component (C) is metal salt of organic carboxylic acid having 6 to 32 carbon atoms and/or a phosphite based compound.

5. The flame retardant polyester fiber for artificial hair according to claim 1, wherein the flame retardant polyester fiber is formed by air-cooling melt spinning process.

6. The flame retardant polyester fiber according to claim 1, which has a monofilament size of 10 to 80 dtex.

7. The flame retardant polyester fiber for artificial hair according to claim 1, wherein the component (C) is metal salt of organic carboxylic acid having 6 to 32 carbon atoms.

8. The flame retardant polyester fiber for artificial hair according to claim 7, wherein the metal salt of organic carboxylic acid having 6 to 32 carbon atoms is at least one component selected from the group consisting of metal salts of caproic acid, caprylic acid, capric acid, lauric acid, myristic acid, palmitic acid, stearic acid, arachidic acid, behenic acid, lignoceric acid, and montanic acid.

* * * * *